United States Patent [19]

Chong et al.

[11] Patent Number: 4,646,216

[45] Date of Patent: Feb. 24, 1987

[54] PLEATED LAMPSHADE COVER AND THE METHOD OF MAKING IT

[76] Inventors: Catherine S. Chong; Andrew K. Chong, both of 1632 Hemstock Ave., Wheaton, Ill. 60187

[21] Appl. No.: 704,863

[22] Filed: Feb. 25, 1985

[51] Int. Cl.[4] ..... F21V 1/06

[52] U.S. Cl. ..... 362/352; 362/357; 493/950; 428/35

[58] Field of Search ..... 362/351, 408, 352, 433, 362/357, 434, 414; D26/118, 130; 493/950, 349; 428/35, 181

[56] References Cited

U.S. PATENT DOCUMENTS 2,224,950 12/1940 Burke ..... 362/358
2,404,162 7/1946 Brown ..... 493/950
4,383,291 5/1983 Gall ..... 362/361

FOREIGN PATENT DOCUMENTS 717382 10/1927 United Kingdom ..... 362/433
7682 of 1938 United Kingdom ..... 362/352

*Primary Examiner*—E. Rollins Cross

[57] ABSTRACT

A method of covering a lampshade with pleated fabric to enhance its decorative value. The pleated fabric is attached to elastic bands circumferentially, at predetermined markings, so that when applied onto the lampshade, the pleats are evenly spaced, which is essential in a decorative item. This method has the distinct advantages of ease of application and consistently reproducible results.

2 Claims, 4 Drawing Figures

PLEATED LAMPSHADE COVER AND THE METHOD OF MAKING IT

BACKGROUND OF THE INVENTION

Although fabric color coordination plays such an important role in interior decoration concerning drapery, bedspread, wallpaper and furniture, lampshades tend to remain a drab beige or some neutral color in order not to clash with the color of other objects in the room. This is because of the difficulty involved in obtaining a lampshade using a fabric of one's choice. If one wants a lampshade using a fabric of one's choice to coordinate with the drapery or bedspread, it is necessary to have the factory custom-make the lampshade, incurring considerable expense. The use of a lampshade cover made of the fabric of one's choice to cover the plain lampshade would solve the problem. However, up till now, the methods used to make pleated lampshade covers involve punching holes in the lampshade for attachment, or using adhesives to glue the cover on. This damages the lampshade and makes it unavailable for future use without the lampshade cover, or when another cover is needed. Moreover, shipping the lampshade could result in damage during shipment. Another problem is the need for shipping the lampshade in bulky containers, incurring high expenses. Another drawback of the usual hole-punching method or glueing method is the difficulty of using these methods even by professionals. An attempt at overcoming these difficulties was described by Burke (1940) using elastic bands for attachment. However, using the art described by Burke, one can only produce unpleated or flat-pleated covers, not accordion-pleats, which are more decorative. Moreover, with the Burke method, the elastic bands are attached to the edges of the fabric at its upper and lower ends, hence making them visible. The purse-string effect of the elastic bands also causes it to look like a dust-jacket rather than a decorative item.

The objective of the present invention is to overcome all the difficulties described above, and provide an accordion-pleated lampshade cover that coordinates with the decor of the room, that can be made from a variety of fabric of different color and design, that can be changed easily and as often as necessary without damage to the lampshade.

Another important objective of the invention is to provide a lampshade cover with accordion-pleats that does not look like a dust-jacket or cover, but resembles a professionally customised lampshade.

A further objective of the present invention is to provide a lampshade cover that is not only a decorative item, but that can also be economically and easily made. The customer who wants a lampshade cover customised should not have to send the lampshade to the shop, incurring significant expense of shipping and possible damage during shipment.

BRIEF SUMMARY OF THE INVENTION

The objective of the present invention is to provide a new method of making and attaching a pleated fabric onto a lampshade, or its wire frame, to enhance its decorative value. The method is easy to use with consistently reproducible results, does no damage to the lampshade to be covered, and is removable for cleaning. Last but not least, the present invention is advantageous over prior art in that the evenness of the pleats on the lampshade is not dependent on the expert judgement of the human eye, but inherent to the method itself.

The pleated lampshade cover is attached circumferentially to two elastic bands, one near the top and the other near the bottom of the pleats. The pleats now stay on the lampshade because the elastic bands grip to the lampshade. While the gripping action of the elastic bands is obvious to all, what is not obvious is the precise way (to be disclosed in the detailed description) the pleats have to be attached onto the elastic bands to achieve evenness of the pleats, a feature vital in a decorative item.

DETAILED DESCRIPTION OF THE INVENTION

Figure 1:
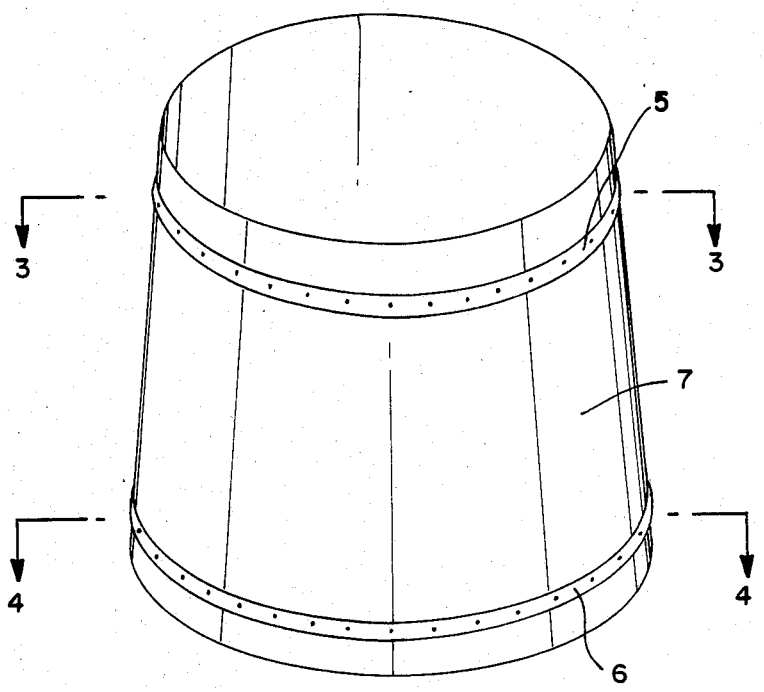
FIG. 1 is a perspective view of the plain lampshade on which the pleated fabric is to be applied. Elastic bands are in place.
Figure 2:
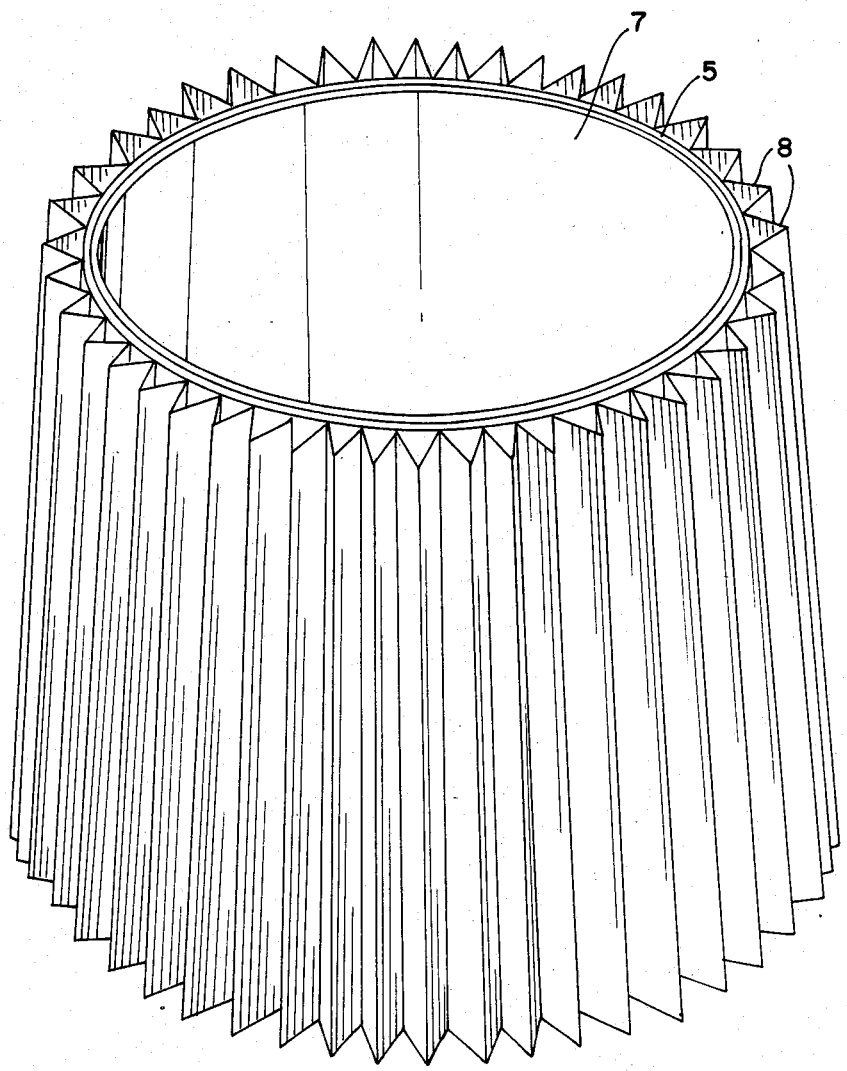
FIG. 2 is a perspective view of the lampshade with the pleated fabric in place.
Figure 3:
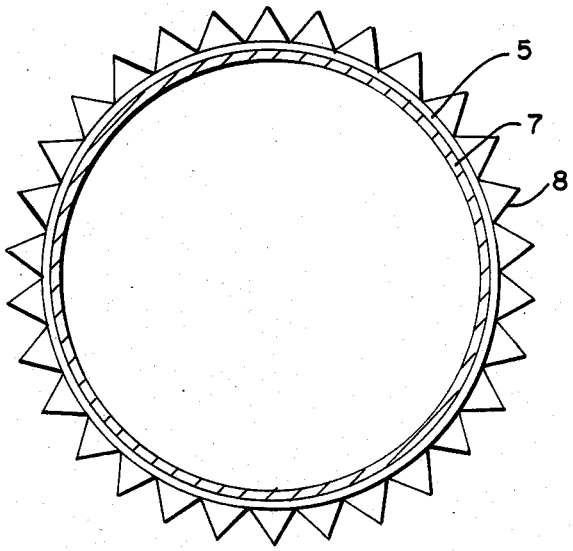
FIG. 3 is a cross-sectional view taken on line 3—3 of FIG. 1.
Figure 4:
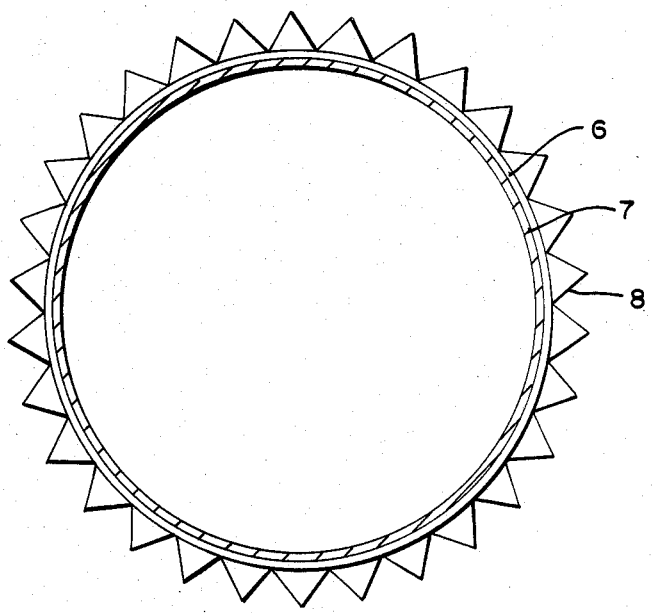
FIG. 4 is a cross-sectional view taken on line 4—4 of FIG. 1

A pleated lampshade cover using a fabric that matches the decor of the room can be used to transform a plain or old lampshade into a decorative item.

The fabric to be used is first measured out in the usual way and fused to Styloshade with a hot iron to stiffen the material. Accordion pleats are made by marking three-quarter inch intervals along the length of the fabric, and creasing the lines with the flat side of a knife or similar object. So far what has been described is not new and so details have not been provided. However, from this point on, the method used is the invention, and will be described in detail.

In this invention, elastic bands are used to attach the pleated fabric onto the lampshade The elastic bands used could be of any width, although ordinarily half to one inch width is used. A non-rolling type of elastic is preferable. The length of the first elastic band to be used 5 is determined by measuring the top circumference of the lampshade, and using a length of elastic 5% less. The length of the second elastic band to be used 6 is similarly determined by measuring the bottom circumference of the lampshade, and using a length of elastic 5% less. As an example, if the circumference is 40 inches, the length of elastic used should be 38 inches. The ends of the elastic bands are joined together to form an elastic ring. The elastic rings are now fitted over the lampshade around the top and bottom to check for a snug fit. It should fit snugly without misshaping the lampshade. It should be noted that the 5% stated above is an approximation, and depends on the type of elastic used. As long as the elastic band fits snugly in place and does not mis-shape the lampshade, the length used is correct.

While the elastic bands are fitted at the appropriate place around the top and bottom of the lampshade, markings are placed at half-inch intervals along the length of the top elastic band. The number of markings along this top elastic band is counted, and the same number of equally spaced markings should be made along the lower elastic band. The intervals between the markings along the lower elastic band are determined by dividing the circumference of the elastic ring (while it is on the lampshade) by the number of markings required. A straight-sided drum lampshade will have equal circumferences top and bottom, and the distances between the markings along both the top and bottom elastic bands will be identical. A cone-shaped lampshade, on the other hand, will have a wider circumference at the bottom than at the top, and the distances between markings along the lower elastic band will be greater than those along the top elastic band.

Once the markings have been made, the elastic bands can now be removed from the lampshade, and each band could be attached to the pleats on the wrong side of the fabric, half-inch from the top and bottom edges of the fabric. Starting at one end of the fabric, the pleats are now joined to the markings previously made on the elastic bands using needle and thread. Two stitches are put through each point to obtain a secure hold, and continued with a loose slip stitch. When all the markings on the elastic bands are attached, the last pleat is overlapped to the first, and the excess trimmed off. By attaching the pleats to the markings, the tension of the elastic bands will ensure that the pleats are evenly spaced when the cover is pulled over the lampshade.

This method works just as well if the fabric is to be attached directly to the wire frame. It is also applicable to lampshades that are oval or angular, since the elastic will conform to whatever circumferential shape it is applied on. Moreover, any appropriate covering material can be used, although fabric is the most common.

From a commercial standpoint, this method has significant advantages, in that the customer who wishes to have a customised lampshade cover made does not need to bring the lampshade to the shop. All she has to do is to send in measurements of the height and the upper and lower circumference of the shade.

While the above method uses two elastic bands, it should be noted that any number of elastic bands (one or more) may be used, depending on the shape and size of the lampshade and the wishes of the maker. In the foregoing description, markings were first made in the upper elastic loop. While this is customary, it need not necessarily be the case. Any elastic loop could be marked first to determine the number of pleats, then all the remaining elastic loops could be marked according to the method described above. The first elastic loop thus marked is the reference loop.

It should also be noted that the sizes of the pleats, the arrangement of the pleats, and the design of the pleats may be varied. Size of pleats depends on the depth of the fold of the fabric and the distance of the interval markings on the elastic bands. The arrangement of the pleats could alternate large and small pleats singly or in groups. The design of the pleats could include use of 'V' shaped or 'U' shaped accordion-pleats. These are merely examples to show the versatility of the method, and should not be construed as an exhaustive listing of its possibilities.

We claim:

1. An accordion-pleated lampshade cover comprising:

a cover material folded to form accordion-pleats along its length, said material being stiff enough to keep its shape;

at least one circumferential elastic band in a stretched position on the lampshade, said band having even interval markings made along its stretched length wherein said markings could be grouped variably, such markings used as points of attachment to inner spokes of the accordion-pleats of the cover, said elastic band being attached to the wrong side of and spaced from the edge of the material.

2. A method of making an accordion-pleated lampshade cover comprising:

(a) folding a cover material to form accordion-pleats along its length, said material being stiff enough to keep its shape;

(b) cutting a length of a first elastic band a few inches shorter than the circumference of the lampshade at a selected position;

(c) checking to see that the elastic band when applied on the lampshade as a loop fits snugly without distorting the shape of the lampshade;

(d) repeating steps (b) and (c) for other circumferential elastic bands in their respective positions as necessary;

(e) joining the two ends of each elastic band to form a loop;

(f) placing the elastic loops in their respective positions on the lampshade;

(g) marking one of said elastic loops as a reference loop with even interval markings along its length;

(h) marking the other loops with even interval markings along its length with the same number of markings as the reference loop, the interval being determined by mathematically dividing the circumference of the lampshade at the level of attachment of the loop by the number of markings along the reference loop;

(i) marking points of attachment along inner spokes of the pleats with a straight edge by compressing the accordion pleats;

(j) attaching the inner spokes of the pleats to the elastic loops in a relaxed position;

(k) starting with a first pleat and ending with a last over lapping pleat;

(l) removing excess length of pleated material, and retaining the last overlapping pleat, making certain that the last pleat points inwards;

(m) securing the last overlapping pleat to the first pleat.

* * * * *